United States Patent [19]

Beleckis

[11] Patent Number: 4,576,497

[45] Date of Patent: Mar. 18, 1986

[54] EASEL TYPE RING BINDER CONSTRUCTION

[75] Inventor: Vytautas K. Beleckis, East Longmeadow, Mass.

[73] Assignee: Dennison National Company, Holyoke, Mass.

[21] Appl. No.: 765,846

[22] Filed: Aug. 15, 1985

[51] Int. Cl.[4] ..... B42F 13/00; A47B 23/00

[52] U.S. Cl. ..... 402/73; 281/33

[58] Field of Search ..... 402/70, 71, 72, 73, 402/74; 281/33, 45; 428/441, 441.1, 444, 451, 454, 455

[56] References Cited

U.S. PATENT DOCUMENTS

| | | | |
|---|---|---|---|
| 888,472 | 5/1908 | Cook | 402/70 |
| 2,778,153 | 1/1957 | Raby | 248/441.1 |
| 2,861,854 | 11/1958 | Best | 248/444 |
| 3,135,532 | 6/1964 | Rankin et al. | 281/33 |
| 3,366,359 | 1/1968 | Wolf et al. | 281/33 |
| 3,738,606 | 6/1973 | Millen | 248/460 |
| 4,181,282 | 1/1980 | Oliver et al. | 248/460 |

*Primary Examiner*—Paul A. Bell
*Assistant Examiner*—Paul M. Heyrana, Sr.
*Attorney, Agent, or Firm*—Chapin, Neal & Dempsey

[57] ABSTRACT

Easel type ring binder includes a generally U-shaped support member with parallel leg portions slidably fitted into tubular sheaths disposed along the opposite side edges of the ring mechanism of the binder. Each leg of the support member is hinged at corresponding points intermediate its opposite ends for pivotable movement of the outer end of the support member to a binder support position in which the outer portion of the support member is disposed at an acute interior angle relative to the inner portion thereof. The sheaths are slotted to provide stops and the legs include protections engageable with the stops to limit the withdrawal of the legs from within said sheaths.

6 Claims, 7 Drawing Figures

EASEL TYPE RING BINDER CONSTRUCTION

BACKGROUND OF THE INVENTION

This invention relates to easel type ring binders also called "easel-back" binders which comprise more or less conventional loose leaf ring binders having movable support members which may be oriented to enable an "open" binder to be supported on a work surface, such as a desk, in an upstanding position suitable for convenient hands-off viewing. An important consideration is to provide a binder of this type which is constructed so that the support member, when not in use, may be compactly and inconspicuously housed so as not to interfere with the customary use of the ring binder and which can be easily and reliably employed to perform its easel support function.

Ring binders of the easel type have been known in the prior art and the following U.S. patents disclose such binders: U.S. Pat. Nos. 2,451,694; 2,778,153; 3,135,532, and 3,334,920.

In the earliest of these prior patents, a rod-like easel support member is pivotably mounted on hinge eyes affixed adjacent the upper end of the ring binder metal. The easel support member is concavely curved for a flush-fit against the curved back panel of the binder whereby the support is undesirably disposed externally of the binder.

In U.S. Pat. No. 2,778,153, another pivotable easel type support is shown which is adapted to be urged by coil spring 23 against the outer surface of the back panel of the binder when it is not being used for its support function.

In U.S. Pat. No. 3,135,532, another easel type support is shown which is adapted to be compactly housed within the binder, except for its prong portions 19. In order to utilize the support member, it must first be fully removed from the housing, reversed end-to-end and its prong-end connected to the fitting disposed on the upper end of the binder.

The principal object of this invention is to provide a binder having an easel type support of improved construction in which the easel support member is partially retracted telescopically from its housed position within the binder and its outer portion hingedly swung to a binder support orientation.

Another object of this invention is to provide an easel type binder of the above type in which the easel support member is of generally flat or planar overall construction for compact and inconspicuous storage within the binder.

A further object of this invention is to provide an easel type binder of the above type in which the support member has inner and outer end portions which are hinged together to enable the outer portion to be swung to-and-from its coplanar orientation within the binder to-and-from an acute angular orientation for easel type binder support.

The other objects and advantages of this invention will be more readily apparent from the following description read in conjunction with the accompanying drawings in which.

Figure 1:
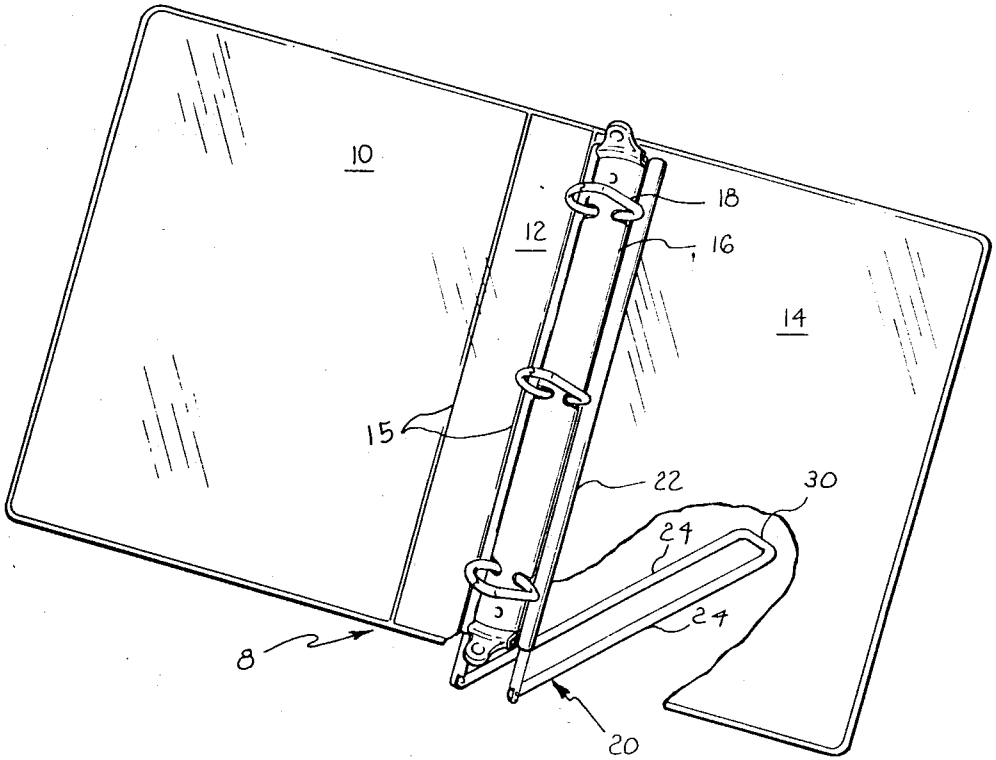
FIG. 1 is a perspective view, with a portion cut away, of a ring binder of the type embodying this invention.

Referring now in detail to the drawings, an easel type binder 8, also referred to as an easel-back binder, is shown generally in FIG. 1. The binder comprises cover panels 10, 12 and 14 hingedly interconnected along longitudinally extending hinge lines 15 formed in a conventional manner. A ring mechanism 16 is affixed to the inner edge portion of cover panel 14 adjacent panel 12 of the binder 8. The ring menchanism includes a plurality of longitudinally spaced mating ring segments 18 which may be opened and closed for the insertion and/or removal of loose leaf sheets in the conventional manner. The easel-back support feature of the binder 8 comprises a generally flat or planar, U-shaped support member 20 which is telescopically disposed within a pair of tubular sheaths 22 disposed along the side edges of the ring mechanism 16.

The U-shaped support member 20 includes a pair of laterally-spaced parallel inner leg portions 26 which are hinged, as at 28, to a pair of spaced outer leg portions 24, interconnected at their outer ends by a cross-bar outer end portion 30. The support member may be any suitable material, such as plastic, wood or metal rod stock and, as shown, may be formed in any suitable cross-sectional shape, such as round, oval or rectangular.

Figure 2:
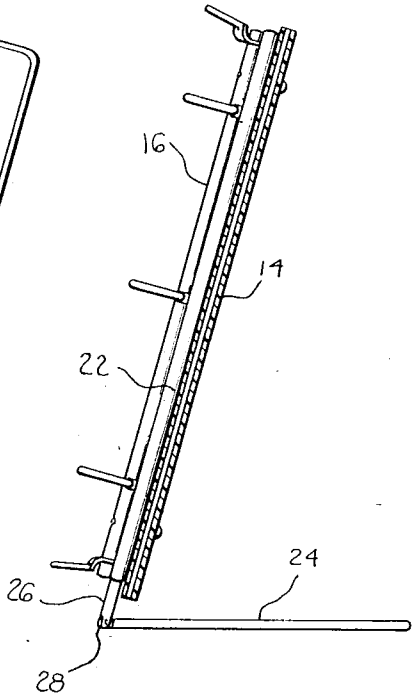
FIG. 2 is a side elevational view of the binder of FIG. 1 with a part thereof shown in cross-section.

The support member 20 is of sufficient length so that when its outer portion 24 is moved to its binder support position, as shown in FIGS. 1 and 2, it will provide sufficient stability to support a fully loaded ring binder 8 in a generally upright and slightly inclined position on a desk or table without the need to hold the binder or use additional support means. In the embodiment shown, the inner leg portions 26 measured to the hinges 28 are about 3 inches, the outer leg portions 24 are about 5 inches and the cross-bar portion 30 is about 1¼ inches. Of course, these dimensions will vary depending upon the size of the binder but the major consideration in selecting such dimensions is that the stability of the binder be commensurate with minimum cost of materials and simplicity of construction.

Figures 3, 4, 5, 6, 7:
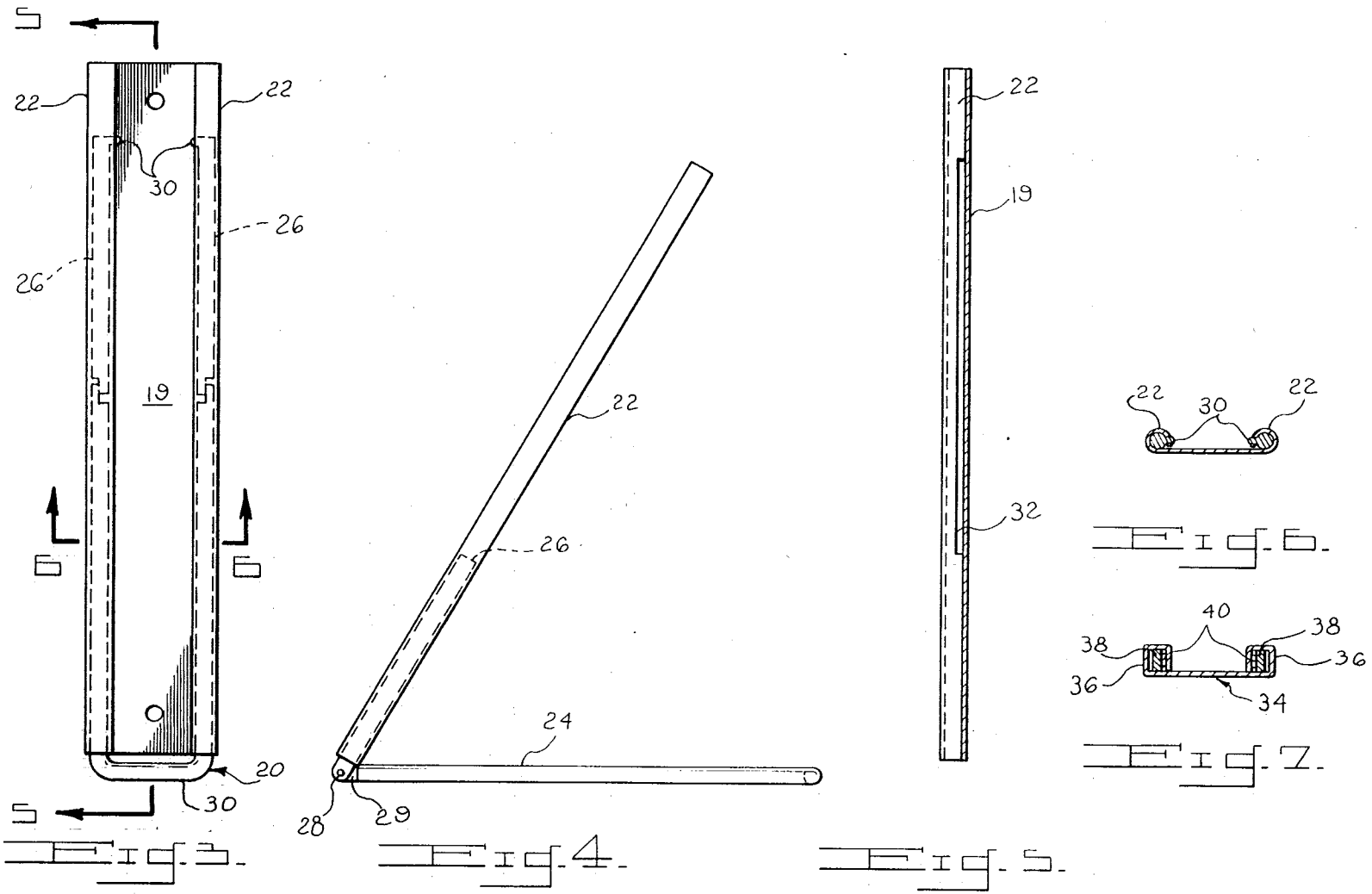
FIG. 3 is a partial plan view of the easel-back support member of FIG. 1 with the parts thereof in a different positional relationship.
FIG. 4 is a side elevational view of the components shown in FIG. 3 with the parts thereof disposed in operative relationship.
FIG. 5 is a section taken along 5—5 of FIG. 3.
FIG. 6 is a section taken along line 6—6 of FIG. 3.
FIG. 7 is a sectional view similar to FIG. 6 illustrative of an alternative embodiment of this invention.

The hinge arrangement 28 may be any suitable type and, in the embodiment depicted, each of the mating leg portions is notched or cut-out to form a shoulder 29 (FIG. 4). The shoulders on each rod are disposed to interengage and act as stops for the angular movement of the inner and outer portions of the support member, as best illustrated in FIG. 4. It has been found that an interior angle of about 60° between the inner and outer portions of the support provides the best results insofar as supporting the binder in a suitable easel type position for ease of use while having sufficient stability to be maintained in that upright orientation without the need of any additional support.

The support member 20, as best illustrated in FIGS. 3 and 6, telescopically fits into a pair of tubular sheaths 22, except for its outer end, transverse portion 30. The sheaths 22 are preferably formed along the side edges of the base plate 19 of the ring mechanism 16 and the plate 19 is adapted to be fastened, to such as by rivets, to the binder cover 14.

The width of the plate 19, between the inner edges of the sheath 24, is such that the arched portion of the ring mechanism fits nicely therebetween so that when the support member 20 is not in use, it will not modify to any apparent extent and appearance or size of a conventional ring binder of the same size and type.

The sheaths 22 are preferably integral with the base plate 19 but, if desired, could be made separate and fastened to the binder or binder mechanism. The cross-sectional dimension of the sheaths are such as to readily accommodate the sliding movement of the leg portions of the support member within the sheaths. When fully inserted, the inner ends of the support member are disposed considerably short of full length of sheaths 22.

Stop means is provided to limit the extent of the outward movement or withdrawal of the stop member from the sheaths 22. In the embodiment shown, the inner ends of the leg portions 26 each includes a small projection or stop lug 30 (FIGS. 3 and 6) which extends laterally inward from each leg portion of the stop member. As shown in FIGS. 5 and 6, each of the projections 30 fits into a longitudinal slot or track 32 provided along opposed inner edge portions of the sheaths 22. The lengths of these slots are approximately equal to the length of the outer portion 24 of the support to permit full insertion of the stop member into the sheaths 22 and sufficient outward movement thereof to enable the outer end portion thereof to be retracted and swung to its binder support position, as best illustrated in FIG. 1.

An alternate construction of the support member and housing is illustrated in FIG. 7 in which mounting plate 34 includes a sheath 36 along each side edge thereof which is of rectangular, tubular cross-section rather than circular in cross-section, as illustrated in FIG. 6. In this embodiment, while the support member is similar to the support member 24 and performs essentially the same function, the tubular sheaths 36 are not provided with elongated slots, as at 32 in FIG. 5. Instead, a small tab 40 is struck from the inner wall portion of each sheath to provide stop means at a predetermined location to limit the extent of withdrawal of the support member from the sheaths. The stop tabs are located at approximately the same distance from the lower end of the sheaths 36 as the lower ends of the cutouts 32 as in FIG. 5. At its inner end, each leg portion 38 of the support member is provided with a small inwardly extending projection similar to the projection 30 in FIG. 3 but in this embodiment, the size of the projection is such as to enable it to slide freely within the sheaths 36 until contacting the stop tabs 40 (FIG. 7). It will be recognized that when not being used, the support member may be almost entirely sheathed within the binder except for its small outer end portion 30. When it is to be used, the support member may be easily retracted by simply clasping its cross-bar portion and pulling outwardly the stop members of the sheath and support come into contact. At that point, the outer portion is simply swung upwardly to its support position shown in FIG. 4. The binder may then be used for studying, lecturing or the like in this orientation, when such use is completed, the user need simply to lift the binder with one hand and at the same time swing the outer portion of the support member 20 back to its planar orientation. A direction inward thrust will return the support to its sheath condition, as shown in FIG. 3.

Having thus disclosed this invention, what is claimed is:

1. Easel type ring binder which has front and back covers, a ring mechanism affixed within said binder and a binder support comprising a generally U-shaped member having a cross-bar portion at its outer end and two parallel, laterally spaced leg portions, each of said leg portions include a hinge at corresponding locations along the length thereof whereby an outer end portion of the support is pivotable relative to the inner portion thereof, at least one of said hinges including stop means for limiting the pivotable movement of the outer end portion of the support to a predetermined acute angle relative to the inner portion, said binder including means for telescopically receiving therein substantially the full length of the leg portions of said support member.

2. Easel type ring binder as set forth in claim 1, in which the inner and outer portions of said support member are pivotable to generally coplanar relationship for telescopically fitting the leg portions thereof within said receiving means of said binder.

3. Easel type ring binder as set forth in claim 2, in which said receiving means comprises a pair of tubular sheaths disposed within the said binder along the side edges of the ring mechanism, said sheaths and said support member including interengageable stop members for limiting the extent of withdrawal of the leg portions of the support member from said sheaths.

4. Easel type ring binder as set forth in claim 2, in which said support member is a rod of circular cross-section, said tubular sheaths being circular in cross-section and dimensioned to slidingly receive therein the leg portions of the support member, each of said sheath including a longitudinal cutout having a length approximately equal to the portion of said support member measured from the hinges to the cross-bar portion, a lateral projection on the inner end portions of each of said legs which fits slidably into each of said cutouts.

5. Easel type ring binder as set forth in claim 2, in which said support member is rectangular in cross-section and slidably fits within said tubular sheaths which are also rectangular in cross-section, a wall portion at each of said sheath being struck inwardly to form a stop tab and each of said leg portions of the support member being provided with a laterally extending projection adapted to engage said stop tab to limit the extent of withdrawal of the stop member to a distance approximately equal to the length of the outer end portion of the support member.

6. Easel type ring binder as set forth in claim 3, in which said sheaths are formed along the outer side edge portions of a plate which provides the base for the ring mechanism.

* * * * *